US005158349A

United States Patent [19]

Holland et al.

[11] Patent Number: 5,158,349

[45] Date of Patent: Oct. 27, 1992

[54] MULTI-COLOR CHEMICAL LIGHTING DEVICE

[75] Inventors: Stanley Holland, Novato; Luc Noel, Salinas; Jerome Renard, West Hollywood, all of Calif.

[73] Assignees: Lexington & Associates, Inc., Northridge; Liquid Labs, Inc., Salinas, both of Calif.

[21] Appl. No.: 725,438

[22] Filed: Jul. 3, 1991

[51] Int. Cl.[5] ..... F21K 2/00

[52] U.S. Cl. ..... 362/34; 362/101; 252/700; 116/206; 206/569

[58] Field of Search ..... 362/34, 84, 101; 252/700; 116/206; 206/524.4, 569

[56] References Cited

U.S. PATENT DOCUMENTS

| | | | |
|---|---|---|---|
| 2,681,168 | 6/1954 | McMillion . | |
| 3,350,553 | 10/1967 | Cline | 362/34 |
| 3,539,794 | 11/1970 | Rauhut et al. . | |
| 3,576,987 | 5/1971 | Voight et al. . | |
| 3,584,211 | 6/1971 | Rauhut . | |
| 3,752,406 | 8/1973 | McDermott et al. . | |
| 3,808,414 | 4/1974 | Roberts | 362/34 |
| 3,875,602 | 4/1975 | Miron . | |
| 3,888,784 | 6/1975 | Pighin et al. | 252/700 |
| 4,076,645 | 2/1978 | Vega . | |
| 4,379,320 | 4/1983 | Mohan et al. . | |
| 4,678,608 | 7/1987 | Dugliss . | |
| 4,751,616 | 6/1988 | Smithey | 362/34 |
| 4,814,949 | 3/1989 | Elliott | 362/34 |
| 5,067,051 | 11/1991 | Ladyjensky | 362/34 |

FOREIGN PATENT DOCUMENTS

| | | | |
|---|---|---|---|
| 2-152101 | 6/1990 | Japan | 116/206 |

*Primary Examiner*—Ira S. Lazarus
*Assistant Examiner*—Y. Quach
*Attorney, Agent, or Firm*—Majestic, Parsons, Siebert & Hsue

[57] ABSTRACT

A method of fabricating chemical lighting devices, comprising coextensive inner and outer tubes, wherein the inner tube contains multiple, segregated oxalate components, is described. Upon activation the device generates a distinct multi-color array of light.

12 Claims, 2 Drawing Sheets

MULTI-COLOR CHEMICAL LIGHTING DEVICE

FIELD OF THE INVENTION

The invention relates to self-contained chemical lighting devices and more particularly to multi-color chemiluminescent light devices.

BACKGROUND OF THE INVENTION

It is often desirable to have a source of visible light that is generated by chemical means and that is not dependent on electricity. One such chemical system employs chemiluminescent light wherein the luminosity is solely the result of chemical reactions. Another important aspect of chemiluminescent light is that the chemical reaction generates only a negligible amount of heat energy, thus, chemiluminescent devices can be used with little risk, if any. Chemiluminescent light devices are particularly useful in emergencies where sources of electrical power are unavailable. See, for instance, U.S. Pat. No. 3,875,602, issued Apr. 8, 1975.

The chemicals that are used in chemiluminescent light devices are generally known. See U.S. Pat. No. 3,576,987, issued May 4, 1971, and U.S. Pat. No. 4,076,645, issued Feb. 28, 1978. Typically, chemiluminescent light is produced by the reaction of a catalyzed hydrogen peroxide (activator) mixture with an oxalate mixture. Bis(6-carbopentoxy-2,4,5-trichlorophenyl) oxalate "CPPO" is often used as the oxalate component. The particular color of the chemiluminescent light generated depends on the particular dye or mixture of dyes (or fluorescers) used. Red, blue, white, orange, pink, or aqua color can be generated to service the particular demand. See U.S. Pat. No. 4,678,608, issued Jul. 7, 1987. In addition, other chemicals such as catalysts are added to enhance production of chemiluminescent light, for storage stabilization and other purposes.

Self-contained chemical lighting devices generally comprise an outer flexible, light-transmitting tube containing the oxalate-fluorescer mixture and an inner, rigid tube containing the hydrogen peroxide mixture. When the inner container is broken, the two mixtures react to produce chemiluminescent light.

In prior art devices, the chemiluminescent light that is generated in any particular device consists of light within only one spectral range. In other words, only one color is generated. When it is desired to generate more than one color at the same time, it is mandatory to have two or more separate devices which are often physically attached one to another. The use of multiple devices increases the cost and decreases the versatility of employing chemical lighting devices.

SUMMARY OF THE INVENTION

It is an object of the present invention to provide a simultaneous multi-color emitting chemiluminescent light device.

It is another object of the invention to provide a cost effective multi-color emitting device that does not require an impervious barrier separating two or more chambers that contain different fluorescer mixtures.

These and other objects are accomplished with the present invention which is based in part on the discovery that a critically long and narrow tube that is sealed at both ends can provide sufficient capillary wall resistance along the lateral mass of the reaction mixture compositions to practically preclude lateral admixing even under agitating conditions. Thus, a chemical lighting device that contains multiple oxalate-fluorescer mixtures can be fabricated. Upon activation of the inventive chemiluminescent lighting device, the activator and respective oxalate mixtures readily admix and react to generate multi-color chemiluminescent light. For devices containing two different (and separated) oxalate-fluorescer mixtures, two separate chemiluminescent reactions occur: one between the first oxalate and the activator to generate light of a first color and the other between the second oxalate mixture and the activator to generate light of a second color. Furthermore, because the two oxalate mixtures do not admix even after activation, the two colors generated remain distinct.

In one aspect of the invention, chemical light devices are fabricated by a process in which an inner tube is partially filled with a first oxalate mixture. Thereafter, critical force is applied on the first oxalate mixture to push it against the sealed end of the inner tube so that substantially no residual coating of the first oxalate mixture remains on the inner tube surface. Thereafter, a second oxalate mixture is added into the inner tube and again force is applied to facilitate the oxalate into the tube. Enough oxalate mixture is added so that when the inner tube is sealed, substantially no air space remains within the inner tube. The inner tube is thereafter placed into an outer tube that has been partially filled with an activator mixture. The outer tube is then sealed.

DESCRIPTION OF THE PREFERRED EMBODIMENT

Figure 1:
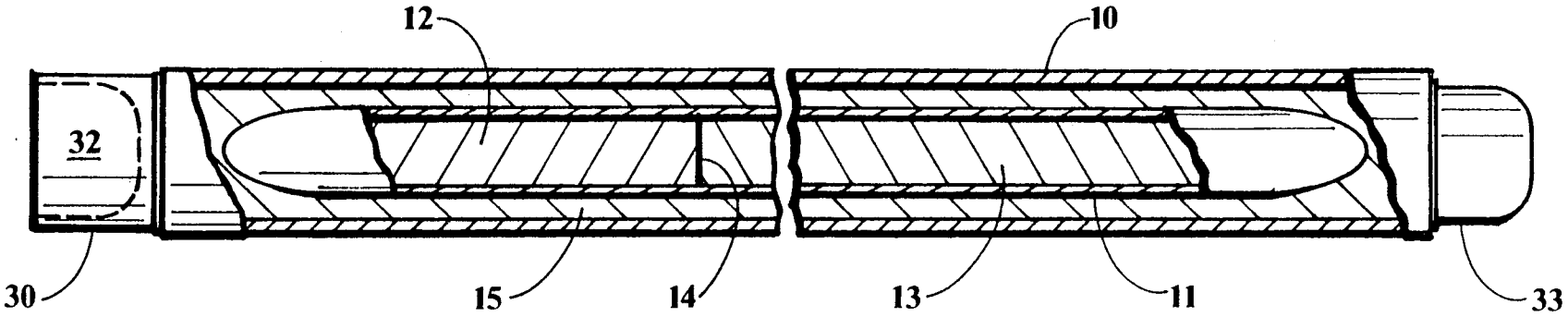
FIG. 1 shows a two color chemiluminescent device.

Referring to FIG. 1, the chemical lighting device comprises a flexible outer tube 10 which contains a rigid inner tube 11. In this embodiment, the inner tube contains two oxalate components. The inner tube is also referred to as an ampule. Generally, different oxalate mixtures have different dye or fluorescer components therein even though the oxalate found in each may be the same, i.e., CPPO. Different dye components will generate visible light of different colors upon reaction with the activator. The first oxalate mixture 12 is situated in the left section of the inner tube and the second oxalate mixture 13 is situated on the right section. Except at interface 14 where the two oxalate mixtures meet, there is practically no mixing of the two oxalate mixtures. The relative amounts of the two oxalate mixtures can vary, although it is generally preferred that in a two-oxalate mixture system, the amounts are roughly equal. The outer tube contains the activator component 15 which essentially surrounds the inner tube 11.

In general, the inner container of the inventive lighting device comprises a long rigid, breakable, cylindrical tube with a small cross-sectional area. However, the configuration of the inner container need not be cylindrical, for instance, its cross-section could be any polygon. But regardless of the cross-sectional configuration of the inner container, the length of the container should be substantially greater than its diameter or other cross-sectional dimension. The inner container, or ampule, can be made of glass. It is to be understood that the term "tube" is not restricted to structures having only cylindrical cross-sections and the cross-section may comprise any suitable polygon as well.

For necklaces and bracelets, a thin-walled and fragile ampule is preferred. The inner container can be enclosed or sealed by conventional means such as heat resealing, chemical bonding, capping or mechanical bonding (e.g., pinched sealed).

With regard to the outer container, its configuration can also vary, although with cylindrical inner ampules, the outer container will usually comprise a coextensive, flexible cylindrical tube. The outer container can be made of any suitable material including plastics such as polyethylene or polypropylene. As with the inner container, the outer container is enclosed or sealed by conventional means.

For necklaces or bracelets, wherein the outer containers can consist of long tubes, means are available at each end so that the tube can be joined to form a loop. In the embodiment of FIG. 1, end 30 of the outer tube 10 defines a recess 32 into which the other end 33 fits snugly. This attachment arrangement is analogous to "male" and "female" connections used in pipes.

For most necklaces and bracelets, the outer tube comprises a plastic cylindrical tube with an outer diameter of approximately 0.1 to 0.4 inches, preferably about 0.205 inches and an inner diameter that can be adjusted to accommodate the size of the inner tube, but which commonly ranges from 0.05 to 0.3 inches. The rigid inner tube comprises a breakable, cylindrical tube with an outer diameter of approximately 1.65 mm and inner diameter of approximately 1.25 mm. The length of the inner and outer tubes can vary from approximately two inches to forty inches or more, although for necklaces the outer tube length is approximately 23 inches and for bracelets the length is approximately 8 inches. The inner tube is usually approximately one inch shorter than the length of the outer tube. The ends of the outer tubes can be connected to each other by any suitable attachment device. The structures of FIGS. 1 and 2 are greatly exaggerated in that the actual length of each device is much longer relatively to its diameter.

It has been found that the cylindrical outer tube should have an inner diameter of approximately 0.3 inch or less. This insures that admixing between the respective oxalate-fluorescer mixtures remains negligible even when the device is agitated.

Figure 2:
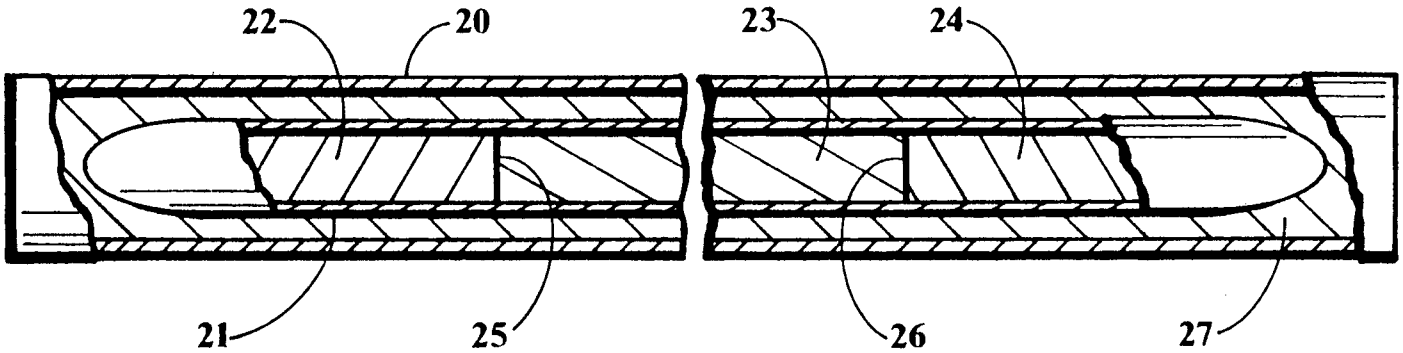
FIG. 2 shows a three color chemiluminescent device.

Referring to FIG. 2, is another embodiment of the inventive chemical lighting device which comprises outer flexible tube 20 and rigid inner tube 21. Within the inner tube are oxalate components 22, 23 and 24, each occupying a separate region of the inner tube. Except at interfaces 25 and 26, there is no mixing of the oxalate components. Activator component 27 fills the inside of outer tube 20 and surrounds the inner tube. In this embodiment, oxalate components 22, 23 and 24 could be three separate components. In the alternative, oxalate components 22 and 24 could be the same. The inner tube can contain more than three separate oxalate components, if desired.

To activate the inventive devices as shown in FIGS. 1 and 2, the rigid inner tube is broken, usually by flexing the device, thereby causing the oxalate components to mix with the activator component. In the embodiment in FIG. 1, the activation brings about two separate chemiluminescent reactions: one between oxalate mixture 12 and the activator component and the other between oxalate mixture 13 and the activator. Thus, two colors will be generated. Furthermore, the two colors remain distinct as the two oxalate components do not mix even after activation.

In the embodiment as shown in FIG. 2, upon activation, two or three colors are generated. If oxalate components 22 and 24 are the same, then the device generates two colors, whereas if oxalate components 22, 23 and 24 are all different, then the device generates three colors. Again, the color bands remain segregated.

Figure 3:
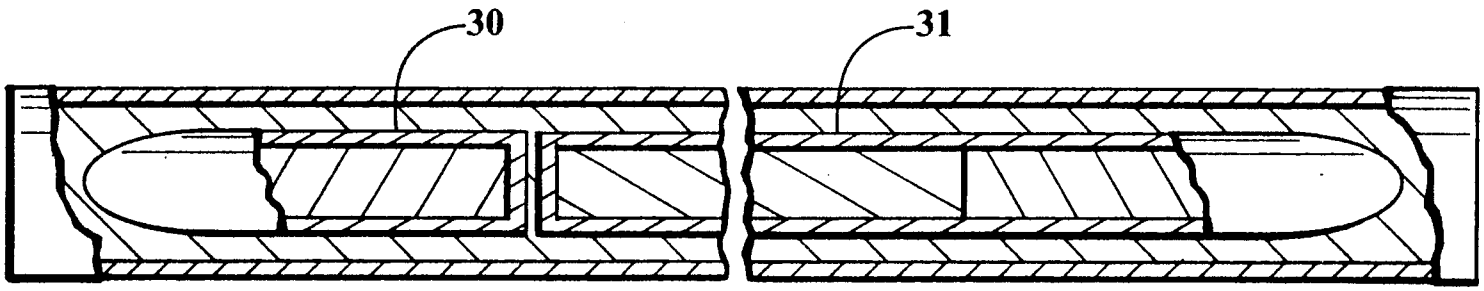
FIG. 3 shows a multi-color chemiluminescent device with multiple ampules.

As noted above, an important aspect of this invention is that the respective oxalate fluorescer mixtures do not admix even after activation. This phenomenon is observed even if more than one ampule is used. Thus, multi-color chemiluminescent devices can employ (1) a single ampule with multi oxalate-fluorescer mixtures or (2) multiple ampules with each containing one or more oxalate-fluorescer mixtures, as shown in FIG. 3, which illustrates a multi-color chemiluminescent device having two ampules designated 30 and 31. With prior art devices that had attempted to employ multiple ampules, it was found that the oxalate-fluorescer mixtures admix upon activation. This post activation admixing was observed regardless of whether the oxalate-fluorescer mixtures are enclosed in the ampules or filled the interstitial space between the outer tube and inner ampules.

In accordance with the present invention, the process of manufacturing chemical light devices comprises partially filling a breakable inner tube, that is sealed at one end, with a first oxalate component. A high speed centrifuge is next used to force substantially all of the first oxalate component towards the sealed end of the inner tube. Sufficient force should be applied so that there is substantially no residual coating on the inner tube surface of the first oxalate component.

Next, a second oxalate component is filled into the inner tube and the high speed centrifuge is used to force the second oxalate down to the point at which it meets the first oxalate component. There should be enough of the second oxalate component so that when the inner tube is sealed, the amount of head space (i.e., air space within the inner tube) is kept to a minimum. This prevents the oxalate components from mixing.

In a separate procedure, an outer plastic tube that is sealed at one end is filled with the appropriate amount of an activator component; a high speed centrifuge is also used to push the activator component towards the sealed end. Thereafter, the inner tube is inserted into the outer tube before the remaining end of the outer tube is sealed.

As is apparent, the number of oxalate components can vary from one to three or more. When more than one oxalate component is used, the inventive device, when activated, will produce multi-color light. In other words, each oxalate component when mixed with the activator, generates visible light of a particular color (i.e., wavelength). Moreover, because the oxalate components do not mix even after activation, the multi-color light will remain as distinct bands along the length of the device. Except for a slight blurring at the surfaces where two different oxalate components meet, there is no mixing of the colors.

The choice of oxalate components used will depend on a number of factors including whether the device will be used as emergency lighting or as novelty items, such as necklaces and bracelets. A preferred activator component comprises hydrogen peroxide in a solvent, preferably dimethylphthalate, and a catalyst salt. A preferred oxalate component comprises of bis(6-carbopentoxy-2,4,5-trichlorophenyl) oxalate, "CPPO", a solvent (preferably dibutylphthalate), and a dye or fluorescer which dictates the color of the resulting glow upon activation. Moreover, the concentration of the oxalate and activator components can also vary. Generally, the more concentrated the components are, the more intense the light that is generated will be and the longer the duration of the chemiluminescence. Because the total volume of the oxalate components inside the inner tube will generally be less than the volume of activator components which occupy the interior of the outer tube, the concentration of the oxalate components should be adjusted accordingly.

It is claimed:

1. A multi-color chemiluminescent light device comprising:

a flexible, elongated outer tube;

a rigid, elongated inner tube defining an inner chamber;

said flexible elongated outer and rigid elongated inner tubes defining an outer chamber therebetween;

an activator component in said outer chamber;

at least two oxalate components in said inner chamber, said at least two oxalate components being in discrete sections of said rigid elongated inner tube with contact between the at least two oxalate components but little mixing at the interface between each oxalate component.

2. The multi-color chemiluminescent light device of claim 1 wherein said at least two oxalate components substantially fill said inner chamber so that there is virtually no air space in said inner chamber.

3. The multi-color chemiluminescent light device of claim 1 wherein said outer tube has a first end and a second end, with the second end defining a recess which the first end can fit into snugly.

4. The multi-color chemiluminescent light device of claim 3 wherein said flexible elongated outer tube is of circular cross-section having an inner diameter of between about 0.05 and 0.3 inches.

5. The light device of claim 1 wherein said activator component substantially fills said outer chamber so that there is virtually no air space in said outer chamber.

6. The light multi-color chemiluminescent device of claim 1 wherein, the cross-sectional areas of said outer flexible elongated and inner rigid elongated tubes being dimensioned such that virtually no mixing between said at least two oxalate components occurs along the transverse length of said multi-color chemiluminescent light device.

7. A multi-color chemiluminescent light device comprising:

a flexible, elongated outer tube;

two or more rigid, elongated inner tubes with each rigid elongated inner tube defining an inner chamber;

said flexible elongated tube and said inner tubes defining an outer chamber therebetween;

an activator component in said outer chamber; and at least one oxalate component in each of said inner chambers, wherein the cross-sectional areas of said flexible elongated and inner tubes being dimensioned such that virtually no mixing between said oxalate components occurs along the transverse length of said multi-color chemiluminescent light device.

8. The multi-color chemiluminescent light device of claim 7 wherein said oxalate components substantially fill said inner chambers so that there is virtually no air space in said inner chambers.

9. The multi-color chemiluminescent light device of claim 7 wherein the two or more rigid elongated inner tubes are positioned one behind the flexible elongated other within said outer tube.

10. The multi-color chemiluminescent light device of claim 7 wherein said flexible elongated outer tube has a first end and a second end, with the second end defining a recess which the first end can fit into snugly.

11. The multi-color chemiluminescent light device of claim 10 wherein said flexible elongated outer tube is of circular cross-section having an inner diameter of between about 0.05 and 0.3 inches.

12. The multi-color chemiluminescent light device of claim 7 wherein said activator component substantially fills said outer chamber so that there is virtually no air space in said outer chamber.

* * * * *

UNITED STATES PATENT AND TRADEMARK OFFICE

CERTIFICATE OF CORRECTION

PATENT NO. : 5,158,349
DATED : October 27, 1992
INVENTOR(S) : Holland, et. al.

It is certified that error appears in the above-indentified patent and that said Letters Patent is hereby corrected as shown below:

| | |
|---|---|
| Col. 5, line 34, claim 3 | After the words "claim 1 wherein said", insert the words -- flexible elongated -- |
| Col. 5, line 42, claim 5 | After the word "The" and before the words "light device", insert the words -- multi-color chemiluminescent -- |
| Col. 6, line 1, claim 6 | Delete the phrase "The light multi-color chemiluminescent" and replace with -- The multi-color chemiluminescent light -- |
| Col. 6, line 2, claim 6 | Delete "," after the words "claim 1 wherein" |

UNITED STATES PATENT AND TRADEMARK OFFICE

CERTIFICATE OF CORRECTION

PATENT NO. : 5,158,349

DATED : October 27, 1992

INVENTOR(S) : Holland et al.

It is certified that error appears in the above-identified patent and that said Letters Patent is hereby corrected as shown below:

| | |
|---|---|
| Col. 6, lines 2 & 3, claim 6 | Delete the phrase "outer flexible elongated and inner rigid elongated", and replace with the phrase -- flexible elongated outer and rigid elongated inner -- |
| Col. 6, line 14, claim 7 | After the words "said flexible elongated", insert the word -- outer-- |
| Col. 6, line 19, claim 7 | After the words "flexible elongated", insert the word -- outer -- |
| Col. 6, lines 30 and 31, claim 9 | Delete the phrase "the flexible elongated other within said outer tube" and replace with -- the other within said flexible elongated outer tube -- |

Signed and Sealed this

Ninth Day of November, 1993

Bruce Lehman

*Attest:*

BRUCE LEHMAN

*Attesting Officer*

*Commissioner of Patents and Trademarks*